United States Patent [19]

Wartian

[11] Patent Number: 4,576,405

[45] Date of Patent: Mar. 18, 1986

[54] DOOR LATCH MECHANISM

[75] Inventor: George Wartian, East Detroit, Mich.

[73] Assignee: Wartian Lock Co., St. Clair Shores, Mich.

[21] Appl. No.: 759,512

[22] Filed: Jul. 26, 1985

Related U.S. Application Data

[63] Continuation of Ser. No. 457,497, Jan. 12, 1983, abandoned.

[51] Int. Cl.[4] ..... E05C 1/16

[52] U.S. Cl. ..... 292/191; 292/166; 292/DIG. 57

[58] Field of Search ..... 292/191, 192, 153, 166, 292/173, DIG. 57

[56] References Cited

U.S. PATENT DOCUMENTS

| | | | |
|---|---|---|---|
| 1,331,166 | 2/1920 | Ochsmer | 292/153 X |
| 1,924,898 | 8/1933 | Anderson | 292/173 |
| 2,233,278 | 2/1941 | Aldeen | 292/191 |
| 2,515,560 | 7/1950 | Lickteig | 292/173 X |
| 2,764,441 | 9/1956 | Marko | 292/153 X |

*Primary Examiner*—Richard E. Moore

*Attorney, Agent, or Firm*—Barnes, Kisselle, Raisch, Choate, Wjottemore & Hulbert

[57] ABSTRACT

There is disclosed a door latch mechanism having a sliding latch mounted to slide from a retracted position to an extended position in which it is adapted to engage in a keeper slot to hold the door closed. A pivoted actuator for the latch is adapted to engage a striker during closing of the door to retract the actuator. When the actuator is retracted it retracts the latch. A manual operator for retracting the actuator is operable from the inside or outside of the door. A locking member prevents retraction of the sliding latch to lock the door.

2 Claims, 9 Drawing Figures

DOOR LATCH MECHANISM

This is a continuation of co-pending application Ser. No. 457,497, filed on Jan. 12, 1983, now abandoned.

This invention relates to a latch mechanism and refers more particularly to a door latch mechanism having a sliding latch.

SUMMARY OF THE INVENTION

The door latch mechanism of this invention comprises a sliding latch mounted to slide from a retracted position to an extended position in which it is adapted to engage a keeper to hold the door closed. A pivoted actuator for the latch has a cam surface which is adapted to engage a striker during closing of the door to retract the actuator. When the actuator is retracted, it retracts the latch. A manual operator having a handle is provided to retract the actuator.

Preferably the sliding latch has an antifriction roller engageable with the keeper during its movement to extended position. Also, locking means may be provided for preventing retraction of the sliding latch.

These and other objects of the invention will become more apparent as the following description proceeds, especially when considered with the accompanying drawings.

DETAILED DESCRIPTION

Figure 1:
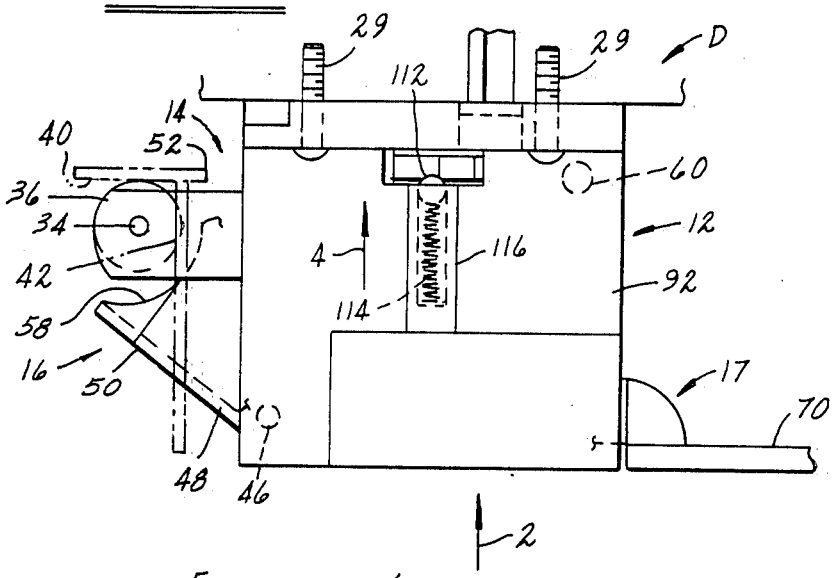
FIG. 1 is a top plan view of a door latch mechanism constructed in accordance with my invention.

Referring now more particularly to the drawings, the door latch mechanism comprises a housing 10, a cover 12, a sliding latch 14, a latch actuator 16, an operator 17 and a locking member 18.

The housing 10 has a rectangular enclosure formed of four walls 20, 22, 24 and 26 extending outwardly from the base 28 and is shown mounted on the inside of a door D by fasteners 29.

Figure 2:
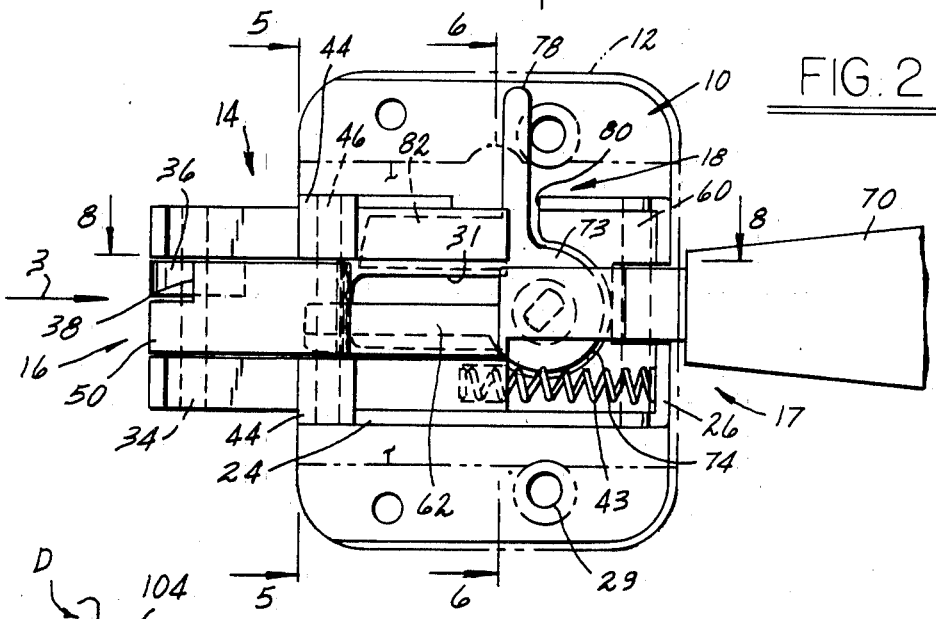
FIG. 2 is an elevational view of the door latch mechanism shown in FIG. 1 with the cover removed and looking in the direction of the arrow 2 in FIG. 1.
Figure 3:
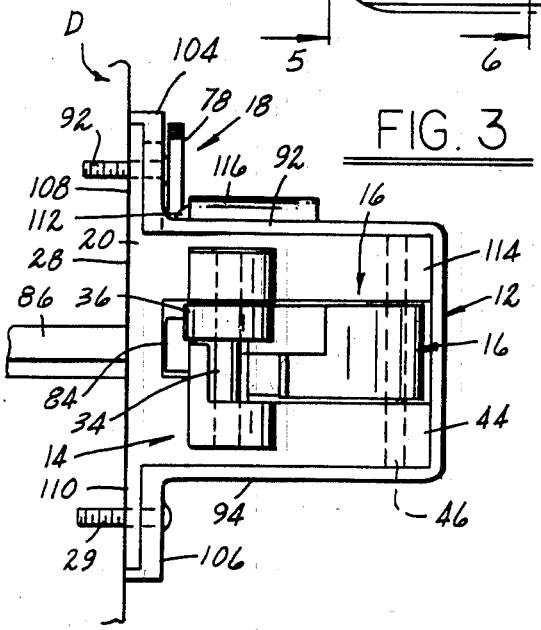
FIG. 3 is a view looking in the direction of the arrow 3 in FIG. 2, with the cover included.
Figure 4:
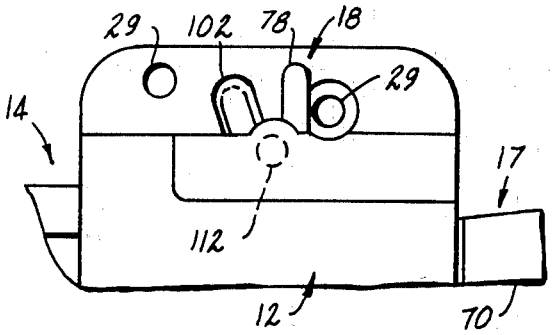
FIG. 4 is a fragmentary view looking in the direction of the arrow 4 in FIG. 1.
Figure 5:
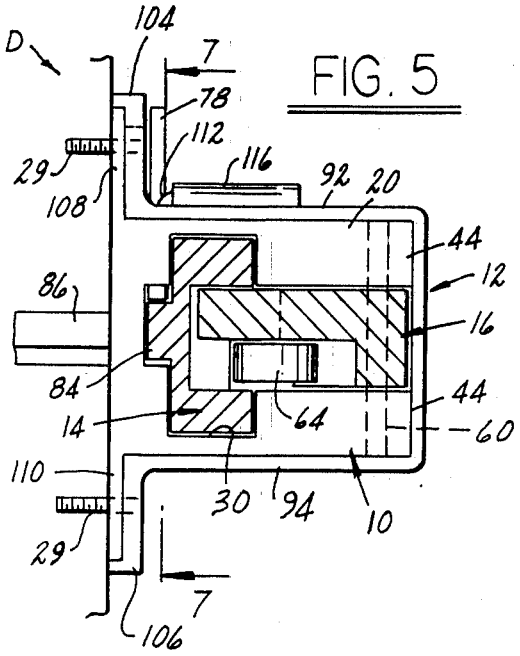
FIG. 5 is a sectional view taken on the line 5—5 in FIG. 2, with the cover included.
Figure 6:
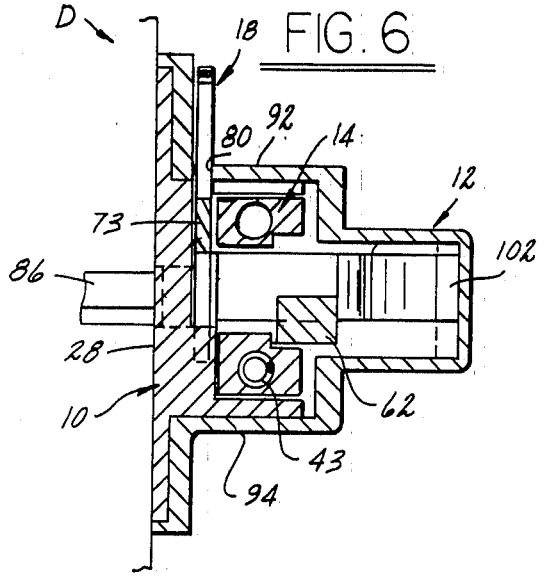
FIG. 6 is a sectional view taken on the line 6—6 in FIG. 2, with the cover included.
Figure 8:
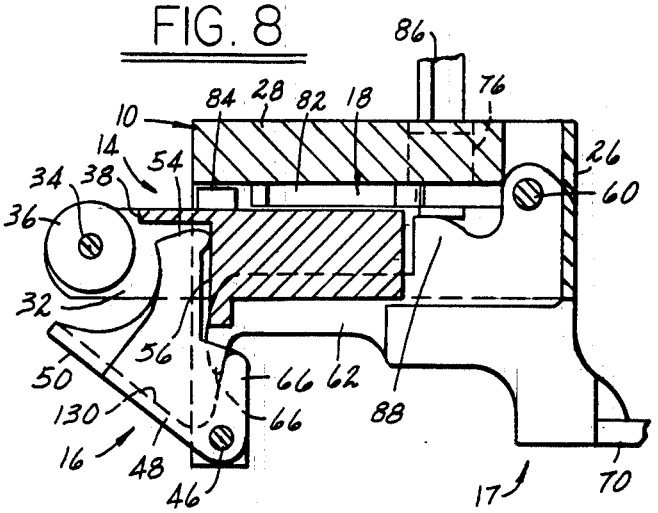
FIG. 8 is a sectional view taken on the line 8—8 in FIG. 2, showing the sliding latch extended.

The sliding latch 14 is an elongated, generally flat rectangular member adapted to slide from retracted position within the housing (FIG. 9) to an extended position extending forwardly through a hole 30 in the front wall 20 of the housing (FIGS. 1, 2 and 8). The latch 14 has an elongated central slot 31 in the rear end to clear operator 17 when the latch is retracted. A recess 32 is formed in the outer surface at the forward end of the slide. A pivot pin 34 extends across this recess, and a roller 36 is mounted on the pin for free rotation with its peripheral surface projecting through a slot 38 in the inner surface of the slide. This roller is adapted to have a rolling contact with the wall 40 of a keeper slot 42 when the latch is extended.

The sliding latch 14 is spring-pressed to its forwardly extending position of FIGS. 1, 2 and 8 by a coil spring 43 compressed between the housing wall 26 and the rear end of the latch.

The housing has a pair of laterally spaced posts 44 extending outwardly from the side walls 22 and 24 of the housing at its forward end, and a pivot pin 46 extends across the space between the outer ends of the posts. The latch actuator 16 is pivoted on the pin 46.

Figure 9:
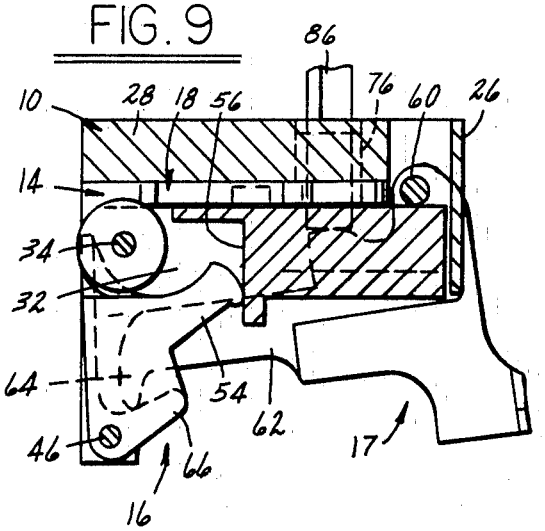
FIG. 9 is a similar to FIG. 8, but shows the sliding latch retracted.

The latch actuator 16 has an arm 48 provided with a cam surface 50 which is adapted to engage the striker 52 adjacent to the keeper slot to retract the actuator from the FIG. 8 to the FIG. 9 position during closing of the door. The actuator has a second arm 54 engageable with the rear wall 56 of the recess 32 in the latch to retract the latch from the FIG. 8 to the FIG. 9 position when the actuator is retracted.

The actuator 16 is located outwardly of the latch. The arm 54 is at the side of the actuator adjacent to roller 36 and the front wall of arm 54 is cut back or recessed where indicated at 58 to clear the roller. The cam surface 50 extends across the full width of the actuator 16 except where the recess 58 cuts through.

The operator 17 is pivoted on a pin 60 which is parallel to pin 46 and located inwardly and rearwardly thereof. Pin 60 is mounted in the walls 22 and 24 of the housing. The operator has an arm 62 extending forwardly from pivot pin 60. Arm 62 has a finger 64 that engages an arm 66 on the actuator 16, which arm 66 is at the opposite side of the actuator from arm 54. When the operator 17 is rotated counter-clockwise in FIG. 8, finger 64 acting on actuator arm 66 causes the actuator to turn clockwise to the FIG. 9 position, retracting the sliding latch 14. The operator has a convenient handle portion 70 for rotating it.

The latch 14 can be locked in its forwardly extending position by a locking member 18 having a circular disc portion 73 disposed in a recess 74 in the base 28 of the housing. The disc portion 73 has a hub 76 rotatably mounted in a hole in the base, permitting the locking member to be turned back and forth on the hub. The disc portion has a lever 78 projecting laterally from the housing through an opening 80 in the side wall 22 thereof, and a forwardly projecting part 82. When the locking member 18 is turned to the dotted line position of FIG. 7, the end of its part 82 is disposed behind an abutment 84 on the extended sliding latch, preventing the sliding latch from retracting. The door may be locked in closed position in this manner. When the locking member is turned to the solid line position of FIG. 7, its part 82 clears the abutment 84, permitting the sliding latch to be retracted. The locking member 18 is turned from one position to the other manually by means of the lever 78.

In addition to being operated by the handle 70 from the inside of the door, the operator 17 may also be operated by a push rod 86 from the outside of the door. The push rod extends through openings in the disc and hub portions 73 and 76 of the locking member 18, and its end engages an enlargement 88 on the arm 62 of the operator. Usually the push rod will have a button or the like on its opposite end outside the door for pushing the rod from its FIG. 8 to its FIG. 9 position, causing the operator 17 to turn counter-clockwise to retract the sliding latch.

The cover 12 is an open shell-like member having sides 92 and 94 extending over the housing walls 22 and 24 and a rear wall 100 extending over the housing rear wall 26. The front of the cover is open to expose the front wall 20 of the housing. The rear wall 100 of the cover has a slot 102 so as not to interfere with the operation of the operator 17. End wall 26 of the housing is similarly slotted. The cover has laterally outwardly extending flanges 104 and 106 which overlie the laterally extending flanges 108 and 110 of the housing, and the fasteners 29 pass through these flanges to mount the latch mechanism on the door. The cover. side wall 96 has a slot 120 through which locking lever 78 passes and the cover flange 104 has a slot 122 to clear lever 78 during assembly of the cover with the housing.

Figure 7:
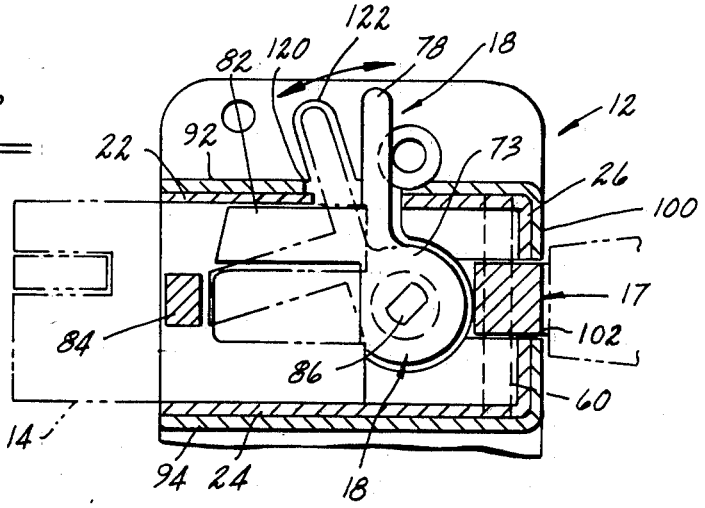
FIG. 7 is a sectional view taken on the line 7—7 in FIG. 5.

The locking member 18 is releasably held in either one of the two positions shown in FIG. 7 against accidental misplacement by a ball 112 pressed against lever 78 by a coil spring 114 located in a tubular portion 116 of the cover side wall 92.

As will be understood from the foregoing description, the sliding latch 14 may be retracted either by means of the operator 17 or by engagement of the actuator 16 with striker 52 during closing movement of the door. There is clearance 130 between the arms 48 and 66 of the actuator 16 to permit the actuator to be retracted by the striker 52 without interference with the finger 64 of operator 17.

In use, the latch mechanism is mounted on the inside of the door as shown in the drawings. When the door is moved towards closed position, and assuming the locking member 18 is in the unlocked solid line position of FIG. 7, the cam surface 50 of actuator 16 will engage striker 52 to retract the actuator from the FIG. 8 to the FIG. 9 position. Retraction of the actuator 16 retracts the sliding latch 14. The sliding latch as well as the actuator 16 will snap out to extended position by the pressure of spring 43 in the fully closed position of the door. The door will be held closed by the engagement of the sliding latch in the keeper slot. During movement of the sliding latch into the keeper slot, the roller 36 has an anti-friction rolling engagement with the surface 40.

The door may be opened by retracting the actuator 16 and sliding latch 14 to the FIG. 9 position. This may be accomplished from the inside of the door by means of operator handle 17, or from the outside of the door by means of push rod 86.

To lock the door, the locking member 18 is moved by its lever 78 to the dotted line position in FIG. 7 to block retraction of the sliding latch.

I claim:

1. A door latch mechanism comprising a housing adapted to be mounted on the inner side of a door, a sliding latch mounted on said housing for sliding movement from a retracted position to an extended position in which it is adapted to engage behind a keeper to hold the door closed, said latch having an abutment surface, spring means urging said latch to its extended position, an actuator pivoted on said housing for pivotal movement from a retracted to an extended position, said actuator having a first arm engageable with said abutment surface of said latch to retract said latch when said actuator is pivoted to its retracted position, said actuator having a second arm positioned and adapted, when said housing is mounted on the door as aforesaid, to cam past said keeper during closing of the door and in the process to pivot said actuator to its retracted position, said actuator having a third arm, an operator pivoted on said housing and having a part engageable with said third arm of said actuator to pivot said actuator to its retracted position when said operator is pivoted in one direction, said operator having a handle portion located on the inner side of the door when said housing is mounted on said door as aforesaid to enable manually pivoting said operator in said one direction from the inner side of the door, said operator having an abutment surface, a manually operated pushed rod extending into said housing from the outer side of said door when said housing is mounted on said door as aforesaid, and means on said housing mounting said push rod for axial sliding movement, said push rod having an end engageable with said abutment surface of said operator to pivot said operator in said one direction in response to axial movement of said push rod in one direction.

2. A door latch mechanism comprising a housing adapted to be mounted on the inner side of a door, a sliding latch mounted on said housing for sliding movement from a retracted position to an extended position in which it is adapted to engage behind a keeper to hold the door closed, said latch having an abutment surface, spring means urging said latch to its extended position, an actuator pivoted on said housing for pivotal movement from a retracted to an extended position, said actuator having a first arm engageable with said abutment surface of said latch to retract said latch when said actuator is pivoted to its retracted position, said actuator having a second arm positioned and adapted, when said housing is mounted on the door as aforesaid, to cam past said keeper during closing of the door and in the process to pivot said actuator to its retracted position, said actuator having a third arm, an operator pivoted on said housing and having a part engageable with said third arm of said actuator to pivot said actuator to its retracted position when said operator is pivoted in one direction, locking means selectively operable to prevent retraction of said latch, said locking means comprising a locking member having a hub portion rotatably mounted in a wall of said housing for rotary movement of said locking member between operative and inoperative positions, said locking member having a part disposed in the operative position of said locking member in a position to block the retraction of said latch and disposed in the inoperative position of said locking member in a position to unblock retraction of said latch, said operator having a handle portion located on the inner side of the door when said housing is mounted on said door as aforesaid to enable manually pivoting said operator in said one direction from the inner side of the door, said operator having an abutment surface, a manually operable push rod extending into said housing from the outer side of the door when said housing is mounted on the door as aforesaid, said push rod being axially slidably mounted in and extending through said hub portion of said locking member and having an end engageable with said abutment surface of said operator to pivot said operator in said one direction in response to axial movement of said push rod in one direction.

* * * * *